United States Patent [19]

Kern et al.

[11] Patent Number: 4,469,944

[45] Date of Patent: Sep. 4, 1984

[54] OPTICAL DISCRIMINATING FIRE SENSOR

[75] Inventors: Mark T. Kern, Goleta; Robert J. Cinzori, Santa Barbara, both of Calif.

[73] Assignee: Santa Barbara Research Center, Goleta, Calif.

[21] Appl. No.: 323,334

[22] Filed: Nov. 20, 1981

[51] Int. Cl.[3] ..... G08B 17/12

[52] U.S. Cl. ..... 250/339; 250/340; 250/349; 340/587

[58] Field of Search ..... 250/340, 342, 339, 349; 340/578, 588, 577, 600, 587

[56] References Cited

U.S. PATENT DOCUMENTS

| | | | |
|---|---|---|---|
| 3,825,754 | 7/1974 | Cinzori et al. | 250/349 |
| 4,101,767 | 7/1978 | Lennington et al. | 250/339 |
| 4,220,857 | 9/1980 | Bright | 250/340 |
| 4,357,534 | 11/1982 | Ball | 250/339 |

*Primary Examiner*—Alfred E. Smith
*Assistant Examiner*—Carolyn E. Fields
*Attorney, Agent, or Firm*—J. Dennis Moore; Mark J. Meltzer; A. W. Karambelas

[57] ABSTRACT

A fire sensor system that can discriminate between a hydrocarbon fire and the effects of a penetration flash has four channels. A first channel of the system detects electromagnetic radiation in a spectral band of relatively long wavelength and a second channel detects electromagnetic radiation in a spectral band of relatively short wavelength. A third channel compares the relative intensity of the radiation detected by the first two channels and will generate a control signal if the ratio of intensities deviates substantially from unity. This third channel control signal, when generated, will be delayed by a first predetermined period of time, and then will trigger an output signal if the first two channels still detect predetermined levels of radiation. The first predetermined delay period is set to be long enough to allow a substantial amount of the radiation of a flash subside.

The sensor system also has a fourth channel that monitors the intensity of the relatively long-wavelength radiation detected by the first channel. If the long-wavelength component increases beyond a predetermined value during a second predetermined time period that begins a third predetermined time period after the third channel control signal is generated, then the output signal will be triggered. The output signal, when generated, can be used to trigger an electro-mechanical suppressant release mechanism.

In another form of the four channel sensor system, the third channel generates its control signal only when the difference between the intensities of the radiation detected by the first and second channels exceeds a predetermined level.

36 Claims, 4 Drawing Figures

OPTICAL DISCRIMINATING FIRE SENSOR

BACKGROUND OF THE INVENTION

1. Field of the Invention

This invention relates generally to the field of fire and explosion sensing and suppression systems, and more particularly to those systems that suppress fires and explosions but discriminate against various types of radiation that may resemble fires or explosions.

2. Description of the Prior Art

Systems for sensing and suppressing fires and explosions are generally known. Some prior art systems have employed two detectors, each detector detecting radiation within different spectral bandwidths. An example of such a system is disclosed in U.S. Pat. No. 3,931,521 to R. J. Cinzori and assigned to the assignee herein. The dual-channel system taught by U.S. Pat. No. 3,931,521 utilizes dual detectors and generates an output signal when both channels detect radiation of a predetermined threshold intensity.

Fire sensor systems must be highly reliable and capable of discriminating against many different types of stimuli that resemble fires and explosions. An example of a successful discriminating fire sensor system is disclosed in U.S. Pat. No. 3,825,754 to R. J. Cinzori, et al. That fire sensor system discriminates against, among other things, the explosion of a round of ammunition which does not subsequently cause a fire.

Another successful discriminating fire sensor system is disclosed in our pending application Ser. No. 269,208, now abandoned, filed June 2, 1981. That sensor system utilizes a third channel to discriminate, among other things, between hydrocarbon fires and the flash caused by a projectile piercing the wall of a monitored area. The decay of the flash is electrically simulated by the system by inhibiting an output signal for a period of time before allowing the system to sense whether a fire has developed after the effects of the flash substantially subside. The disclosures of U.S. Pat. Nos. 3,931,521 and 3,825,754 are incorporated herein by reference.

When a projectile penetrates the wall of a monitored area, the resulting flash effects may persist for a relatively long time (50 milliseconds or more). If no fire results from the projectile penetration, the fire sensor system must not cause the release of suppressant. However, if the penetrating round ignites fuel, a fire can rapidly grow to magnitudes larger than the capacity of the suppressant; the fire sensor system must respond while the growing fire is still manageable. Prior art fire sensor systems are not fully able to handle both long flash decays and the possibility of a rapid fire buildup, and the present invention is directed to the solution of this problem.

SUMMARY OF THE INVENTION

A fire sensor system that discriminates against long flash decays, yet is capable of responding to rapidly building fires comprises a long-wavelength detector channel and a short-wavelength detector channel, and a third channel that inhibits the generation of an output signal when the ratio of the energy detected by the two detector channels exceeds a predetermined ratio. A delay circuit continues to inhibit the generation of an output signal and enables a threshold circuit for a predetermined period of time after the ratio of the energy detected by the two detector channels returns below the predetermined ratio value. The threshold circuit, when enabled, will cause the generation of an output signal if the energy detected by the long-wavelength detector exceeds a predetermined threshold level.

One embodiment of the present invention provides a four channel fire sensor system. A first channel of the system detects electromagnetic radiation in a spectral band of relatively long wavelength and a second channel detects electromagnetic radiation in a spectral band of relatively short wavelength. A third channel compares the relative intensity of the radiation detected by the first two channels and will generate a control signal only if the ratio of intensities is less than a predetermined value. When a flash is seen by the detectors, the third control signal is removed. The regeneration of this third channel control signal will be delayed by a first predetermined period of time after the third channel comparison indicates that a flash has started to decrease and the ratio falls below the predetermined value. The first predetermined delay period is set to be long enough to allow a substantial amount of the radiation of a flash subside.

The sensor system also has a fourth channel that monitors the intensity of the relatively long-wavelength radiation detected by the first channel. If the long-wavelength component exceeds a predetermined value during a second predetermined time period that begins after the third channel control signal is regenerated, then the output signal will be triggered. The output signal, when generated, can be used to trigger an electromechanical suppressant release mechanism.

In another form of the four channel sensor system, the third channel generates its control signal only when the difference between the intensities of the radiation detected by the first and second channels exceeds a predetermined level.

In the absence of a flash large enough to trigger the ratio or comparison of the first two channels, the sensor system performs as a dual spectrum fire sensor similar to prior art sensors.

The general purpose of this invention is to provide a new and improved fire sensor which overcomes the abovedescribed disadvantages of the prior art fire sensors, and which is operable to detect the presence of a fire and cause the release of a fire suppressant.

It is also a purpose of this invention to provide a new and improved fire sensor that is capable of discriminating between a sudden flash of radiant energy and a hydrocarbon fire.

It is a further purpose of this invention to provide a new and improved fire sensor that senses the presence of a building hydrocarbon fire and extinguishes it quickly, yet delays the release of a suppressant where it senses only phenomena that may be transient false alarms.

DETAILED DESCRIPTION OF THE INVENTION

Figure 1:
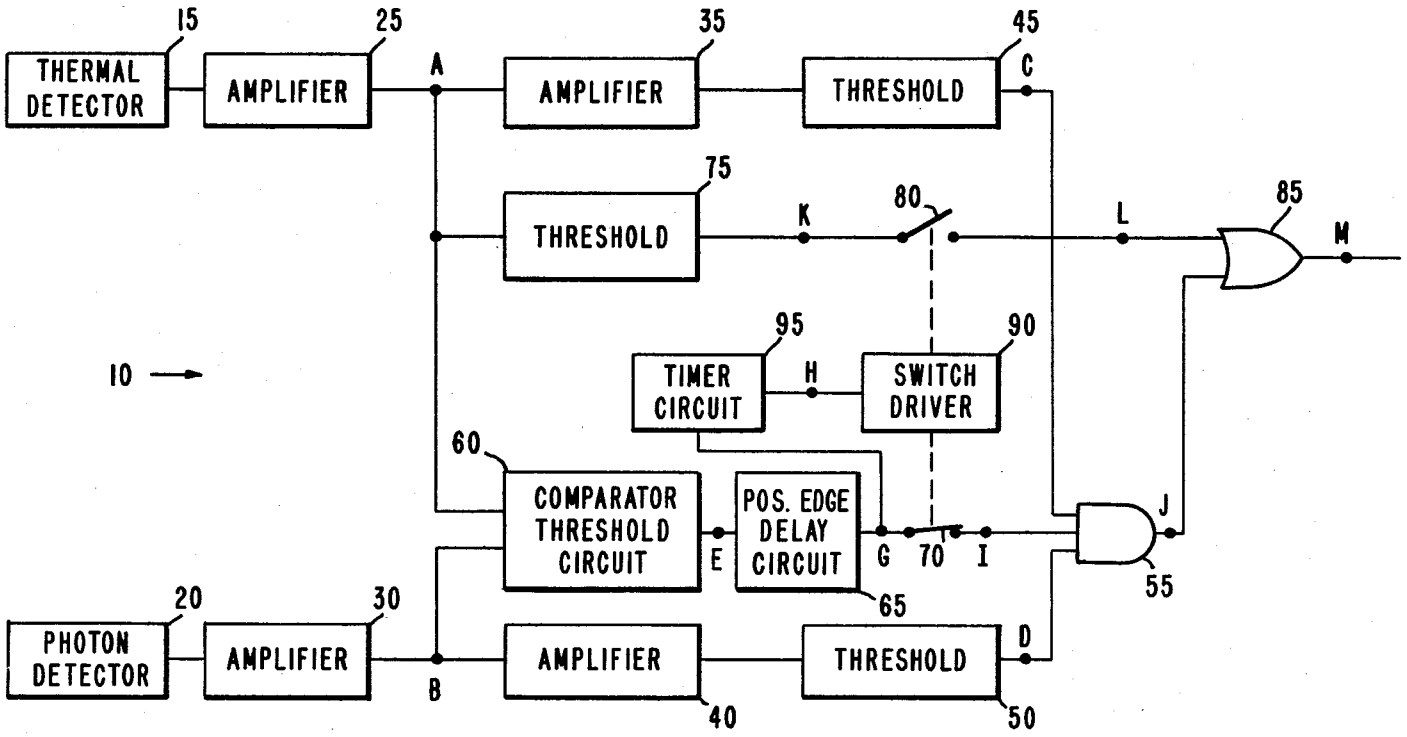
FIG. 1 is a block diagram of one embodiment of the present invention.

Referring to FIG. 1, the fire sensor system 10 comprises a thermal detector 15 that is responsive to radiant energy within a spectral band of relatively long wavelength (3 to 15 microns, for example) and a photon detector 20 that is responsive to radiant energy within a spectral band of relatively short wavelength (0.1 to 1.2 microns, for example). The analog output of each detector 15 and 20 is amplified by the amplifiers 25 and 30 respectively. The outputs of the amplifiers 25 and 30, which are hereinafter called nodes A and B respectively, are fed to the amplifiers 35 and 40 respectively. The output of amplifier 35 is fed to a threshold device 45 having a predetermined threshold level $V_{T1}$. The output of the amplifier 40 is fed to a threshold device 50 having a predetermined threshold level $V_{T2}$. The threshold devices 45 and 50 convert the respective analog outputs of amplifiers 35 and 40 to logical control signals. When the output of amplifier 35 is below the threshold level $V_{T1}$, the threshold device 45 will not generate a control signal (its output is a logical 0); but when the output of amplifier 35 exceeds the threshold level $V_{T1}$, the threshold device 45 will generate a control signal (its output is a logical 1). The threshold device 50 operates in a similar manner. The outputs of the threshold devices 45 and 50, hereinafter called nodes C and D respectively, are fed to an AND gate 55.

The outputs of amplifiers 25 and 30 are fed to a comparator-threshold circuit 60. The comparator-threshold circuit 60 generates a logical control signal only when the ratio of the amplitude of the signal at node B to the amplitude of the signal at node A is more than a predetermined value. The digital output of the comparator-threshold circuit 60 will be called node E and is fed to a fixed delay circuit 65, which transmits the signal exactly as it is received, but adds a predetermined time delay to the positive-going edge of the input waveform. The output of the fixed delay circuit 65 will be called node G, and is fed to the arm of a normally-closed single-pole single-throw switch 70. The contact of the switch 70 will be called node I, and is fed to the third input of the AND gate 55.

The output of the amplifier 25 is also fed to a threshold device 75 having a predetermined threshold level $V_{T3}$. The threshold device 75 will generate a logical 0 when the signal at node A is below $V_{T3}$, and a logical 1 when the signal is at or above $V_{T3}$. The output of the threshold device 75 will be called node K and is fed to the arm of a normally-open single-pole single-throw switch 80. The contact of the switch 80 will be called node L, and is fed to an OR gate 85. The output of the AND gate 55 (node J) is also fed to the OR gate 85.

The state of the switches 70 and 80 is controlled by a switch driver 90. A timer circuit 95 is interposed between node G and the input of the switch driver 90. The output of the timer circuit will be called node H. At the positive-going edge of the output of the fixed delay circuit 65, the timer circuit 95 supplies a logical 1 to the switch driver 90 for the duration of its predetermined time period. If the instantaneous signal fed by the fixed delay circuit 95 to the switch driver 90 is a logical 0, then the switch driver 90 leaves the switch 70 in its normally-closed state and the switch 80 in its normally-open state. If the instantaneous signal fed to the switch driver 90 is a logical 1, the switch driver 90 drives the switch 70 open and the switch 80 closed.

The output of the OR gate 85 will be called node M, and it represents the output of the fire sensor system 10. The signal at node M will remain a logical 0 until the fire sensor system senses the presence of a hydrocarbon fire or explosion, whereupon it will generate a logical 1 signal at node M. Node M is usually connected to an electromechanical fire suppression device (not shown) and the presence of logical 1 at node M will cause the fire suppression device to release its suppressant.

Figure 2:
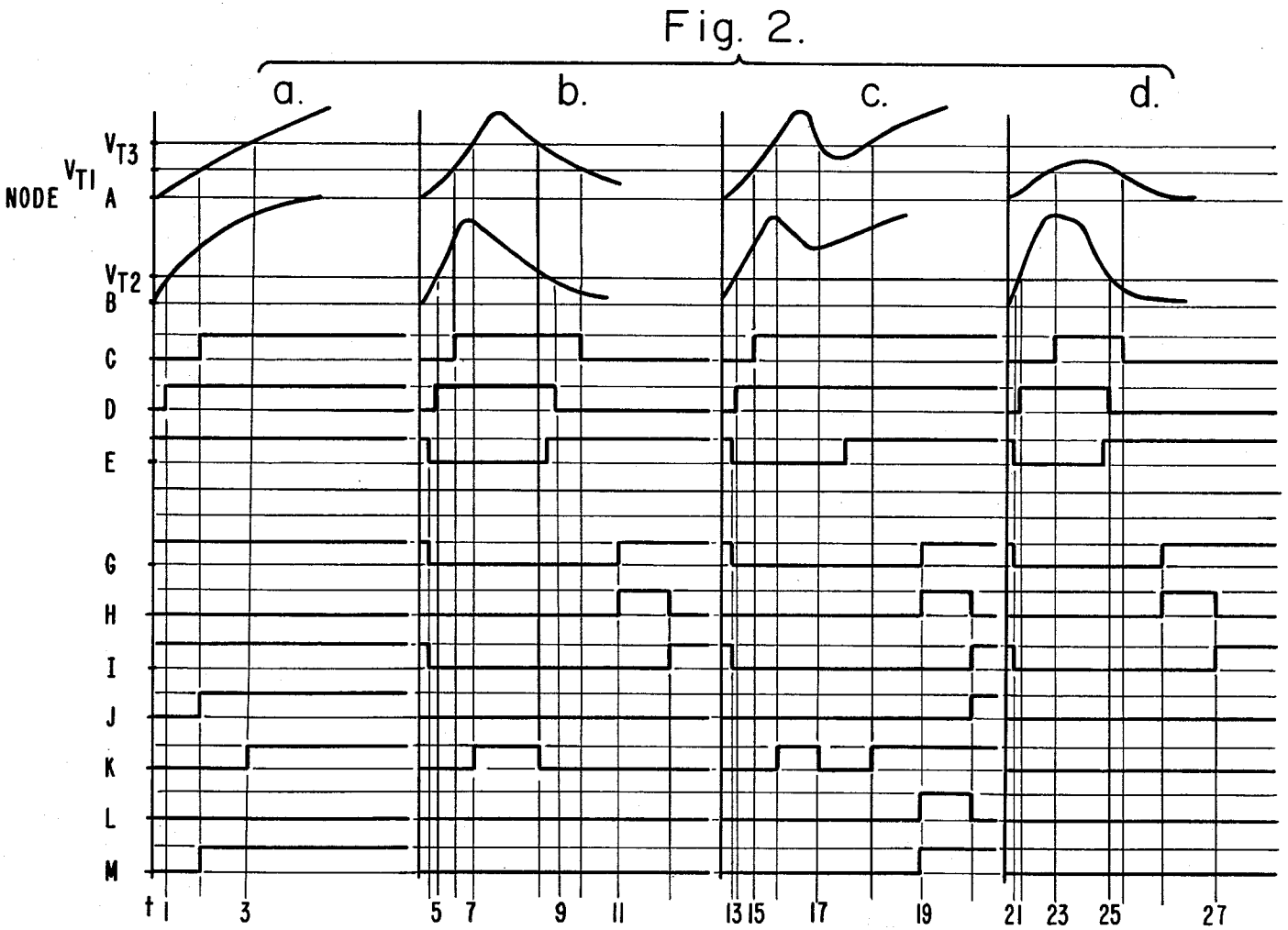
FIG. 2 is a timing diagram for the embodiment shown in FIG. 1. The diagram shows time versus voltage and is not necessarily to scale.

The operation of the fire sensor 10 of FIG. 1 can be illustrated by the timing diagrams of FIG. 2. Four different scenarios are illustrated: in FIG. 2*a*, a fire occurs in the monitored area; in FIG. 2*b*, an explosive round penetrates the wall of the monitored area, but does not cause a fire; in FIG. 2*c*, the explosive round ignites a fire; and in FIG. 2*d*, a beam of light (as from a lamp) strikes the fire sensor's detectors.

In the first scenario, a hydrocarbon fire is ignited and builds up rapidly. The thermal detector 15 and the photon detector 20 detect the fire's radiant energy in their respective wavebands. The thermal detector 15 generates an analog output in response to the energy received in the 3 to 15 microns waveband. The amplified output of the thermal detector 15 is shown as node A in FIG. 2*a*. Likewise, the photon detector generates an analog output in response to the energy received in the 0.1 to 1.2 microns waveband, and the signal present at node B is shown as node B.

When the signal at node A reaches the predetermined level $V_{T1}$ at time $t_2$, it causes the threshold circuit 45 to generate a logical 1. Likewise, when the signal at node B reaches the predetermined level $V_{T2}$ at time $t_1$, the threshold circuit 50 generates a logical 1. The comparator-threshold device 60 generates a logical 1 throughout this scenario since the ratio of the amplitude of the signal at node B to the amplitude of the signal at node A remains below the predetermined value. This logical 1 is transmitted through the delay circuit 65 and the switch 70 to the AND gate 55.

Thus, since at time $t_2$, the signals at nodes C, D, and H are all logical 1's, the AND gate 55 will generate a logical 1 at time $t_2$, as shown at node J in FIG. 2*a*. When the OR gate 85 receives the logical 1 input from the output of the AND gate 55 at time $t_2$, it will generate a logical 1, causing electro-mechanical fire suppressant to be released.

The scenario depicted in FIG. 2*b* occurs when a round pierces the wall of a monitored area causing a flash, but no fire. The amplified outputs of the detectors are shown in nodes A and B. The threshold circuit 45 generates a logical 1 from time $t_6$ to $t_{10}$, and the level comparator 50 generates a logical 1 while the amplitude of node B exceeds $V_{T2}$ from time $t_5$ to $t_9$. The comparator-threshold device 60 will generate a logical 0 as soon as the flash begins because the ratio of signals rises above the predetermined value at time $t_4$. This causes the signal at node G to fall to a logical 0 at time $t_4$. The normally-closed switch 70 transmits the logical 0 to the input of the AND gate 55, thereby inhibiting its output until the fixed delay circuit 65 again generates a logical 1 at time $t_{11}$. The output of the AND gate 55 continues to be inhibited from time $t_{11}$ on because the signals at nodes C and D have fallen to logical 0's. Therefore, the AND gate 55 will not generate a logical 1 and the fire suppressant will not be released. This is the desired result, since the flash would have abated harmlessly by itself in this scenario.

The scenario shown in FIG. 2c occurs when a round pierces a wall of the monitored area and causes a fire. As the round pierces the wall of the monitored area, the resulting flash causes the ratio of the signal at node B to the signal at node A to exceed the predetermined value, and the comparator-threshold 60 will generate a logical 0 at time $t_{13}$. This fall-down is immediately seen by the fixed delay circuit 65 and causes the signal at nodes G and I to fall to 0 at time $t_{13}$. The increasing outputs of the amplifiers 25 and 30 cause the threshold circuits 45 and 50 to generate logical 1's at time $t_{15}$ and $t_{14}$, respectively. Although nodes C and D are high after time $t_{15}$, the comparator-threshold device 60 effectively inhibits the release of suppressant by generating a logical 0 at time $t_{13}$ that inhibits the AND gate 55. When the comparator threshold circuit 60 again generates a logical one, the fixed delay circuit 65 delays transmitting the logical 1 signal for a predetermined period of time that is sufficient to let the dominant flash effect die out.

Th fixed delay circuit generates a logical 1 at time $t_{19}$ which in turn causes the timer circuit 95 to generate a logical 1 for a predetermined time period. Therefore, from time $t_{19}$ to $_{20}$ the switch driver is energized and the switch 70 is opened. This prevents the logical 1 at node G from being transmitted to node I until the switch 70 closes at time $t_{20}$. At time $t_{20}$, the signals at nodes C, D, and I are all logical 1's which would cause the signal at node M to go high, if it had not already done so.

From time $t_{16}$ to $t_{17}$, the signal at node A exceeds the threshold $V_{T3}$ of the threshold circuit 75 and causes it to generate logical 1. But, since the switch driver does not close the switch 80 until time $_{19}$, the signal at node K remains 0. At time $t_{19}$, the fixed delay circuit 65 has again generated a logical 1 at node G. The timer circuit 95 and switch driver 90 hold the switch 80 closed until the switches 70 and 80 to revert to their normal states. However, at time $t_{18}$ the signal at node A will again exceed the $V_{T3}$ threshold level causing the signal at node L to go high. Since the switch driver 90 will have not yet opened the switch 80, the logical 1 at node L will be conducted to the OR gate 85 which will generate a logical 1 output at time $t_{18}$. The output of the OR gate 85 will cause suppressant to be released to extinguish the building fire.

The scenario shown in FIG. 2d occurs when a headlamp beam briefly strikes the detectors 15 and 20 and shows how the fire sensor system can discriminate against such "false alarms". Although the signals at nodes C and D are both high from time $t_{23}$ to $t_{24}$, the AND gate 55 is inhibited by the delayed output of the comparator-threshold device 60 and open switch 70 until time $t_{27}$. Since the signals at nodes C and D fall low before time $t_{23}$, the fire sensor system 10 will not generate a suppression command.

Figure 3:
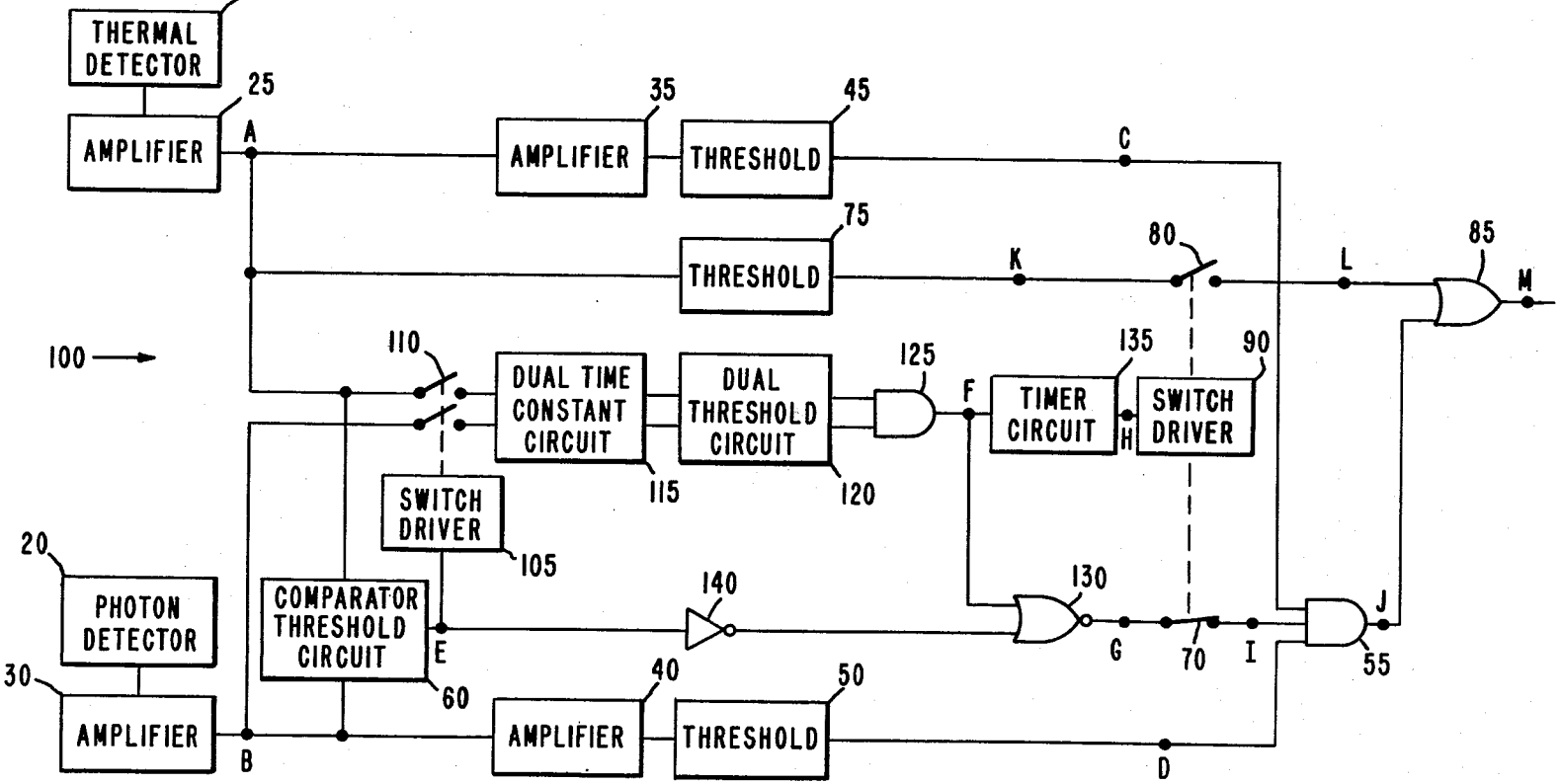
FIG. 3 is a block diagram of another embodiment of the present invention.

The fire sensor system 10 of FIG. 1 can be slightly rearranged for certain applications. In FIG. 3, the fire sensor system 100 is identical to the system of FIG. 1, except that the fixed delay circuit 65 of FIG. 1 has been replaced with an amplitude variable delay circuit. The variable delay circuit comprises a switch driver 105 energized by the output of the comparator-threshold device 60. The switch driver 105 controls the state of two ganged switches 110. One of the ganged switches is interposed beteen node A and one of the inputs to a dual time constant circuit 115, and the other ganged switch is interposed between node B and the other input to the dual time constant circuit 115. The dual analog outputs of the time constant circuit 115 are fed to a dual threshold circuit 120. The dual digital outputs of the dual threshold circuit 120 are fed to an AND gate 125. The output of the comparator-threshold circuit 60 can be called node E and is fed to an inverter 140. The output of the AND gate, hereinafter called node F, and the output of the inverter 140 are fed to a NOR gate 130. The output of the NOR gate 130 is node G and is connected to the arm of the switch 70. Further, the timer circuit 135 is connected between the output of the AND gate 125 and the switch driver 90, instead of at node G as in FIG. 1. The timer circuit 135 generates a logical 1 for a predetermined period of time after it receives a downgoing signal from the AND gate 125.

Figure 4:
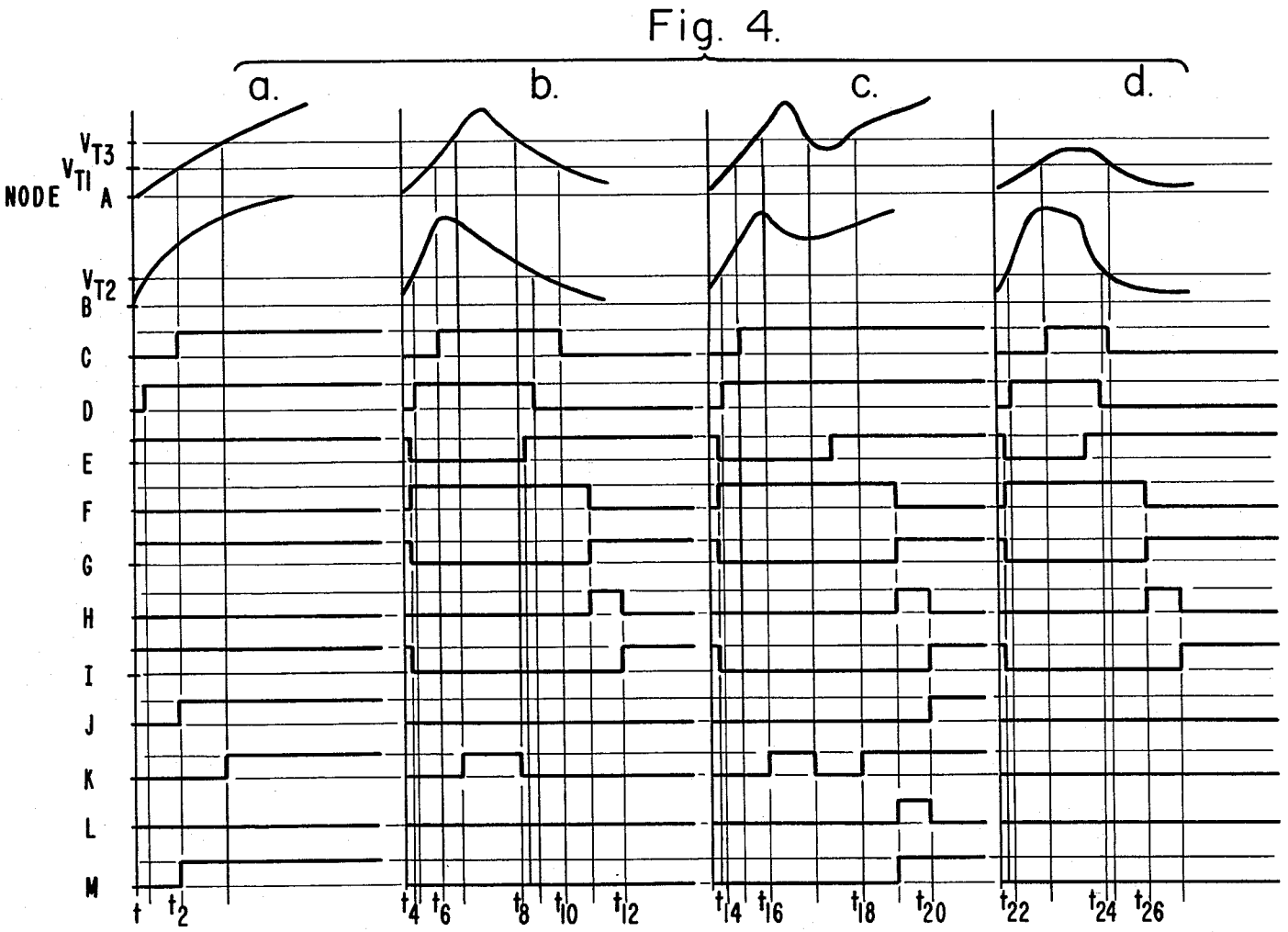
FIG. 4 is a timing diagram for the embodiment shown in FIG. 3. The diagram shows time versus voltage and is not necessarily to scale.

The timing diagram of FIG. 4 shows the operation of the fire sensor system of FIG. 3 in the same four scenarios depicted in FIG. 2. In FIG. 4a, the signal at node B reaches the threshold voltage $V_{T2}$ at time $t_1$ and causes the threshold circuit 50 of FIG. 3 to generate a logical 1. At time $t_2$, the signal at node A reaches the threshold voltage $V_{T1}$ at time $t_2$ causing the threshold circuit 45 to generate a logical 1. Since the ratio of the signal at node B to that at node A is not high enough to trigger a response from the comparator-threshold circuit 60 in this scenario, the signals at nodes G and I remain high. Therefore, the AND gate 55 generates a logical 1 output at time $t_2$, causing the OR gate 85 to also generate a logical 1 output.

In FIG. 4b, the rapidly rising signal at node B causes the comparator-threshold circuit 60 to go low at time $t_4$, which in turn causes the output of the NOR gate 130 to go low. The low signal at node E will cause the switch driver 105 to close the ganged switches 110. The signals at nodes A and B will charge up the daul time constant circuit 115, triggering the dual threshold circuit 120 into generating two logical 1 outputs, which will in turn cause the AND gate 125 to generate a logical 1 at node F at time $t_4$.

The signals at either node E or node F will inhibit the AND gate 55 from generating a logical 1 output by causing the NOR gate 130 to generate a logical 0 from time $t_4$ to $t_{11}$. A time $t_{11}$, when the signals at nodes E and F are high and low, respectively, the NOR gate 130 will generate a logical 1 again. The down-going signal at node F at time $t_{11}$ will cause the timer circuit 135 to energize the switch driver 90, thereby opening the switch 70 and closing the switch 80 from time $t_{11}$ to $t_{12}$. At time $t_{12}$, the signals at nodes C and D will have fallen to logical 0's since the flash will have waned. Thus, no suppression output signal will be generated in this scenario.

In FIG. 4c, the building fire causes the threshold circuit 75 to generate a logical 1 at time $t_{18}$. At time $t_{19}$, the down-going signal at node F causes the switch 80 to be closed, thereby causing a high input to the OR gate 85 and a high output that causes suppressant to be released.

In FIG. 4d, the fire sensor system 100 responds to the false alarm as it did in FIG. 4b, except that the threshold circuit never generates a logical 1 signal, since the signal at node A never exceeds the threshold voltage $V_{T3}$.

It is understood that the above-described embodiment is merely illustrative of the many possible specific embodiments which can represent applications of the principles of this invention. Numerous and varied other arrangements can be devised in accordance with these principles by those skilled in this art without departing from the spirit or scope of the invention.

What is claimed is:

1. A fire sensor system for making energy dissipation comparisons while sensing hydrocarbon fires and explosions above predetermined power thresholds, the system comprising:

(a) low threshold radiation channel means responsive to minimum power fires or explosions for generating a first group of control signals;

(b) high threshold radiation channel means responsive to fires or explosions which exceed a predetermined power threshold for generating a first override control signal; and (c) circuit means coupled to both the first group of control signals and the first override control signal for simulating, in response to said first group of control signals, an explosion by generating a timing signal representative of the duration of said explosion of causing said first override control signal to control the triggering of an output signal during the generation of said timing signal and for causing said first group of control signals to control the triggering of an output signal when said first override control signal is not controlling the triggering of an output signal.

2. A fire sensor system for making power dissipation comparisons while sensing hydrocarbon fires and explosions above predetermined power thresholds, the system comprising:

(a) low threshold radiation channel means responsive to minimum power fires or explosions for generating a first group of control signals;

(b) high threshold radiation channel means responsive to fires or explosions which exceed a predetermined power threshold for generating a second group of control signals;

(c) first circuit means coupled to both radiation channel means for determining plural time segments based on the first and second groups of control signals; and (d) second circuit means coupled to both radiation channel means and the first circuit means for determining which group of control signals should be used to trigger an output control signal.

3. The sensor system of claim 2 wherein the low threshold means comprises:

(a) a first detector means for detecting electromagnetic energy within a first predetermined spectral band and generating a first control signal in proportional response thereto;

(b) a second detector means for detecting electromagnetic energy within a second predetermined spectral band and generating a second control signal in proportional response thereto;

(c) a first threshold means for generating a third control signal when the first control signal exceeds a first predetermined level;

(d) a second threshold means for generating a fourth control signal when the second control signal exceeds a second predetermined level; and (e) third circuit means for generating a fifth control signal when the third and fourth control signals are simultaneously generated.

4. The sensor system of claim 3 wherein the high threshold means comprises a third threshold means for generating a sixth control signal when the first control signal exceeds a third predetermined level.

5. The sensor system of claim 2 wherein the high threshold means comprises:

(a) a detector means for detecting electromagnetic energy within first predetermined spectral waveband and generating a first control signal in proportional response thereto; and (b) a threshold means for generating a second control signal when the first control signal exceeds a predetermined level.

6. The sensor system of claim 5 further comprising:

(a) a second detector means for detecting electromagnetic energy within a second predetermined spectral waveband and generating a third control signal in proportional response thereto;

(b) a second threshold means for generating a fourth control signal when the third control signal exceeds a predetermined level; and (c) third circuit means for generating a fifth control signal when the second and fourth control signals are simultaneously generated.

7. The sensor system of claim 6 wherein the third circuit means generates the fifth control signal when either the second or the fourth control signals are generated.

8. A fire sensor system for making energy dissipation comparisons while sensing hydrocarbon fires and explosions above predetermined power thresholds, the system comprising:

(a) low threshold radiation channel means responsive to miniumum power fires or explosions for generating a first group of control signals;

(b) high threshold radiation channel means responsive to fires or explosions which exceed a predetermined power threshold for generating a second group of control signals;

(c) first circuit means coupled to both radiation channel means for determining plural time segments based on the first and second groups of control signals, where the first circuit means includes:

(i) comparison means for generating a ratio comparison of signals within the first and second groups of control signals, and (ii) timer means for generating time segments based on the amplitude of the output of the comparison means; and (d) second circuit means coupled to both the radiation channel means and the first circuit means for determining which group of control signals should be used to trigger an output control signal.

9. The sensor system of claim 8 wherein the timer means comprises an inhibit means, fed by the comparison means, for inhibiting the generation of the output control signal when (a) the comparison means generates the ratio comparison, and (b) for a predetermined time thereafter.

10. The sensor system of claims 8 or 9 wherein the comparison means generates a control signal that is proportional to the difference between signals within the second and the first groups of control signals.

11. The sensor system of claims 3, 5, 4, 6 or 7 wherein the first spectral waveband lies in the region of 3 to 15 microns, and the second spectral waveband lies in the region of 0.1 to 1.2 microns.

12. A fire sensor system for making energy dissipation comparisons while sensing hydrocarbon fires and explosions above predetermined power thresholds within predetermined time periods, the system comprising:

(a) low threshold radiation channel means responsive to minimum power fires or explosions for generating a first group of control signals;

(b) high threshold radiation channel means responsive to fires or explosions which exceed a predetermined energy threshold for generating a second group of control signals;

(c) first circuit means coupled to both radiation channel means for determining plural time segments based on the first and second groups of control signals; and (d) second circuit means coupled to both radiation channel means and the first circuit means for determining which group of control signals should be used to trigger an output control signal.

13. The sensor system of claim 12 wherein the low threshold means comprises:

(a) a first detector means for detecting electromagnetic energy within a first predetermined spectral band and generating a first control signal in proportional response thereto;

(b) a second detector means for detecting electromagnetic energy within a second predetermined spectral band and generating a second control signal in proportional response thereto;

(c) a first threshold means for generating a third control signal when the first control signal exceeds a first predetermined level;

(d) a second threshold means for generating a fourth control signal when the second control signal exceeds a second predetermined level; and (e) third circuit means for generating a fifth control signal when the third and fourth control signals are simultaneously generated.

14. The sensor system of claim 13 wherein the high threshold means comprises a third threshold means for generating a sixth control signal when the first control signal exceeds a third predetermined level.

15. The sensor system of claim 12 wherein the high threshold means comprises:

(a) a detector means for detecting electromagnetic energy within a first predetermined spectral waveband and generating a first control signal in proportional response thereto; and (b) a threshold means for generating a second control signal when the first control signal exceeds a predetermined level.

16. The sensor system of claim 15 further comprising:

(a) a second detector means for detecting electromagnetic energy within a second predetermined spectral waveband and generating a third control signal in proportional response thereto;

(b) a second threshold means for generating a fourth control signal when the third control signal exceeds a predetermined level; and (c) third circuit means for generating a fifth control signal when the second and fourth control signals are simultaneously generated.

17. The sensor system of claim 16 wherein the third circuit means generates the fifth control signal when either the second or the fourth control signals are generated.

18. The sensor system of claims 13, 14, 16, or 17 wherein the first spectral waveband lies in the region of 3 to 15 microns, and the second spectral waveband lies in the region of 0.1 to 1.2 microns.

19. A fire sensor system for making energy dissipation comparisons while sensing hydrocarbon fires and explosions above predetermined power thresholds within predetermined time periods, the system comprising:

(a) low threshold radiation channel means responsive to minimum power fires or explosions for generating a first group of control signals;

(b) high threshold radiation channel means responsive to fires or explosions which exceed a predetermined energy threshold for generating a second group of control signals;

(c) first circuit means coupled to both radiation channel means for determining plural time segments based on the first and second groups of control signals, where the first circuit means includes:

(i) comparison means for generating a ratio comparison of signals within the first and second groups of control signals, and (ii) timer means for generating time segments based on the amplitude of the output of the comparison means; and (d) second circuit means coupled to both the radiation channel means and the first circuit means for determining which group of control signals should be used to trigger an output control signal.

20. The sensor system of claim 17 wherein the timer means comprises an inhibit means, fed by the comparison means, for inhibiting the generation of the output control signal when (a) the comparison means generates the ratio comparison, and (b) for a predetermined time thereafter.

21. The sensor system of claim 20 wherein the comparison means generates a control signal that is proportional to the difference between signals within the second and the first groups of control signals.

22. The sensor system of claim 19 wherein the comparison means generates a control signal that is proportional to the difference between signals within the second and the first groups of control signals.

23. In a fire suppression system having multiple radiation sensing channels connected to output gate circuitry for generating a fire suppression output signal and further having an energy responsive inhibit channel responsive to a predetermined energy threshold to inhibit the generation of a fire suppression output signal during an inhibit period, the improvement comprising:

(a) threshold radiation channel means responsive to the onset of rapidly rising fires during said inhibit period for generating an inhibit override output signal and (b) means coupled between said threshold radiation channel means and said inhibit channel and responsive to inhibit signals generated therein for passing said inhibit override output signal to said output gate circuitry and thereby generating a fire suppression output signal during said inhibit period.

24. A method for suppressing a fire or explosion or both which comprises:

(a) sensing radiation in one or more spectral bands of the electromagnetic wavelength spectrum and received from said fire or explosion to generate a fire suppression output signal or signals in response thereto, (b) sensing a predetermined energy threshold of radiation received from said fire or explosion for generating a fire suppression inhibit signal during which time said output signals are inhibited; and (c) sensing the level of radiation received from said fire or explosion for generating an inhibit override output signal during said inhibit period when said level of radiation exceeds a predetermined value, whereby said inhibit override output signal is processed to generate a separate fire suppression output signal when necessary for suppressing rapidly rising fires during said inhibit period, and slower rising fires are operative to produce fire suppression signals after the duration of said inhibit period.

25. A method for suppressing the onset of rapidly rising fires during a predetermined time in which slower rising fires are inhibited from generating a fire suppression output signal, which includes:

(a) generating an inhibit signal in response to the receipt of radiation at a level above a predetermined energy threshold;

(b) generating an inhibit override output signal in response to the receipt of radiation at a level exceeding a predetermined level threshold; and (c) passing said inhibit override output signal to output gating circuitry to in turn generate a fire suppression output signal only during the duration of said inhibit signal.

26. A system for suppressing the onset of rapidly rising fires during a predetermined time in which slower rising fires are inhibited from generating a fire suppression output signal, comprising:

(a) means for generating an inhibit signal in response to the receipt of radiation at a level above a predetermined energy threshold;

(b) means for generating an inhibit override output signal in response to the receipt of radiation at a level exceeding a predetermined threshold; and (c) means coupled between the above said means for generating an inhibit signal and an inhibit override output signal respectively for passing said inhibit override output signal to the output of selected gating circuitry in order to in turn generate a fire suppression output signal only during the duration of said inhibit signal.

27. A system for suppressing fires and explosions comprising:

(a) a first means for detecting electromagnetic energy within a first predetermined spectral waveband;

(b) a second means for detecting electromagnetic energy within a second predetermined spectral waveband;

(c) inhibition means for inhibiting the generation of a first control signal when and for as long as the ratio of the energy detected by the first and second detector means exceeds a predetermined ratio value;

(d) delay means for both continuing the inhibition of the generation of the first control signal and enabling a threshold means for generating a second control signal, for a predetermined period of time after the ratio of the energy detected by the first and second detector means returns to a value below the predetermined ratio value; and (e) wherein the threshold means will generate the second control signal when and for as long as the energy detected by the second detector means exceeds a predetermined threshold level and simultaneously the delay means enables the threshold means.

28. A system for suppressing fires and explosions comprising:

(a) a first means for detecting electromagnetic energy within a first predetermined spectral waveband;

(b) a second means for detecting electromagnetic energy within a second predetermined spectral waveband;

(c) inhibition means for inhibiting the generation of a first control signal when and for as long as the difference between the energy detected by the first and second detector means exceeds a predetermined amount;

(d) delay means for both continuing the inhibition of the generation of the first control signal and enabling a threshold means for generating a second control signal, for a predetermined period of time after the difference between the energy detected by the first and second detector means returns below the predetermined amount;

(e) wherein the threshold means will generate the second control signal when and for as long as the energy detected by the second detector means exceeds a predetermined threshold level and simultaneously the delay means enables the threshold means.

29. The system of claims 27 or 28 further comprising an output means for generating an output control signal when either the first or second control signals are generated.

30. A sensor system comprising:

(a) a first detector means for detecting electromagnetic energy within a first predetermined spectral band and generating a first control signal in proportional response thereto;

(b) a second detector means for detecting electromagnetic energy within a second predetermined spectral band and generating a second control signal in proportional response thereto;

(c) discrimination means for generating a third control signal when and only when the ratio of the level of the first control signal to the level of the second control signal is less than a predetermined value;

(d) a first delay means for generating a fourth control signal beginning when the third control signal is regenerated, and continuing for a first predetermined period of time;

(e) a first switch, whose normal state is closed;

(f) a first circuit means for generating a fifth control signal when simultaneously the first control signal exceeds a first predetermined level, the second control signal exceeds a second predetermined level, the fourth control signal is generated, and the first switch is closed;

(g) the first switch being interposed between the first delay means and one input of the first circuit means;

(h) a first threshold circuit for generating a sixth control signal when the first control signal exceeds a third predetermined level;

(i) a second switch, whose normal state is open, interposed between the first threshold circuit and a second circuit means for generating a seventh control signal when either the fifth control signal is generated, or when simultaneously the sixth control signal is generated and the second switch is closed; and (j) a controller means for simultaneously reversing the states of the first and second switches beginning when the fourth control signal ceases to be generated and ending a second predetermined period of time after the fourth control signal ceases to be generated.

31. The sensor system of claim 30 wherein the first predetermined spectral band is the spectral band from approximately 0.1 to approximately 1.2 microns in wavelength and wherein the second predetermined spectral band is the spectral band from approximately 3 to approximately 15 microns in wavelength.

32. The sensor system of claims 30 or 31 wherein the discrimination means generates the third control signal when and only when the difference between the level of the first control signal and the level of the second control signal is less than a fourth predetermined level.

33. A sensor system comprising;

(a) a first detector means for detecting electromagnetic energy within a first predetermined spectral band and generating a first control signal in proportional response thereto;

(b) a second detector means for detecting electromagnetic energy within a second predetermined spectral band and generating a second control signal in proportional response thereto;

(c) discrimination means for generating a third control signal when and only when the ratio of the level of the first control signal to the level of the second control signal is less than a predetermined value;

(d) a first delay means for generating a fourth control signal when:

(i) the first control signal is above a first predetermined level, and simultaneously (ii) the second control signal is above a second predetermined level, and simultaneously (iii) the third control signal is being generated, the fourth control signal then being generated until either of the first or second control signals falls below the first or second predetermined level, respectively;

(e) a first circuit means for generating a fifth control signal when the third control signal is being generated and the fourth control signal is not being generated;

(f) a first switch, whose normal state is closed, interposed between the first circuit means and a second circuit means for generating a sixth control signal when simultaneously the first control signal exceeds a third predetermined level, the second control signal exceeds a fourth predetermined level, the fifth control signal is generated, and the first switch is closed;

(g) a first threshold means for generating a seventh control signal when the first control signal exceeds a fifth predetermined level;

(h) a second switch, whose normal state is open, interposed between the first threshold means and a third circuit means for generating an eighth control signal when either the sixth control signal is generated, or when simultaneously the seventh control signal is generated and the second switch is closed; and (i) a controller means for simultaneously reversing the states of the first and second switches beginning when the fourth control signal ceases to be generated and continuing for a predetermined period of time.

34. The sensor system of claim 33 wherein the first predetermined spectral band is the spectral band from approximately 0.7 to approximately 1.2 microns in wavelength and wherein the second predetermined spectral band is the spectral band from approximately 3 to approximately 15 microns in wavelength.

35. The sensor system of claim 33 or 34 wherein the discrimination means generates the third control signal when and only when the difference between the level of the first control signal and the level of the second control signal is less than a fourth predetermined level.

36. A method of sensing hydrocarbon fires comprising the steps of:

(a) detecting electromagnetic energy within a first predetermined spectral band and generating a first control signal in proportional response thereto;

(b) detecting electromagnetic energy within a second predetermined spectral band and generating a second control signal in proportional response thereto;

(c) generating a third control signal when and only when the ratio of the level of the first control signal to the level of the second control signal is less than a predetermined value;

(d) generating a fourth control signal beginning when the third control signal begins and continuing for a first predetermined period of time;

(e) generating a fifth control signal when the fourth control signal is generated, the fifth control signal beginning a second predetermined period of time after the fourth control signal begins to be generated and continuing as long thereafter as the fourth control signal continues to be generated;

(f) generating a sixth control signal when simultaneously the first control signal exceeds a first predetermined level, the second control signal exceeds a second predetermined level, and the fifth control signal is generated;

(g) generating a seventh control signal when and only when the first control signal exceeds a third predetermined level;

(h) generating an eighth control signal when and only when the seventh control signal is generated during the second predetermined period of time after the fourth control signal begins to be generated; and (i) generating a ninth control signal when and only when either of the sixth or eighth control signals is generated.

* * * * *

UNITED STATES PATENT AND TRADEMARK OFFICE

CERTIFICATE OF CORRECTION

PATENT NO. : 4,469,944

DATED : September 4, 1984

INVENTOR(S) : Mark T. Kern and Robert J. Cinzori

It is certified that error appears in the above—identified patent and that said Letters Patent is hereby corrected as shown below:

Column 7, line 16, delete "of" (second occurrence) and insert therefor --for--.

Column 7, line 68, after "within" add --a--.

Claim 8, line 26, delete "miniumum" and add therefor --minimum--.

Signed and Sealed this

*Nineteenth* Day of *February 1985*

[SEAL]

*Attest:*

DONALD J. QUIGG

*Attesting Officer* *Acting Commissioner of Patents and Trademarks*